United States Patent [19]

Bruce

[11] Patent Number: 4,494,393

[45] Date of Patent: Jan. 22, 1985

[54] APPARATUS AND METHOD FOR PRESS FORMING

[76] Inventor: George T. Bruce, 21 Christina Cresc., Scarborough, Ontario, Canada, M1R 4H7

[21] Appl. No.: 473,955

[22] Filed: Mar. 10, 1983

[51] Int. Cl.[3] ..... B21D 5/02

[52] U.S. Cl. ..... 72/57; 72/382; 72/465

[58] Field of Search ..... 72/465, 389, 382, 396, 72/57

[56] References Cited

U.S. PATENT DOCUMENTS

| | | | |
|---|---|---|---|
| 3,258,948 | 7/1966 | Carlson, Sr. | 72/465 |
| 3,276,239 | 10/1966 | Achler et al. | 72/465 |
| 4,295,352 | 10/1981 | Stokes et al. | 72/465 |

FOREIGN PATENT DOCUMENTS

| | | | |
|---|---|---|---|
| 332813 | 2/1920 | Fed. Rep. of Germany | 72/465 |
| 2147594 | 3/1972 | Fed. Rep. of Germany | 72/465 |
| 2251734 | 5/1974 | Fed. Rep. of Germany | 72/465 |

*Primary Examiner*—Lowell A. Larson

*Attorney, Agent, or Firm*—Dennison, Meserole, Pollack & Scheiner

[57] ABSTRACT

A female die for use in press forming workpieces comprises a longitudinally hingeable plank which hinges under the action of a male die to wrap the workpiece around the male die to conform to the shape thereof. The plank is provided with reinforcing ribs at a portion thereof whereby they do not interfere with a bearing surface for the workpiece.

8 Claims, 2 Drawing Figures

APPARATUS AND METHOD FOR PRESS FORMING

Figure 1:
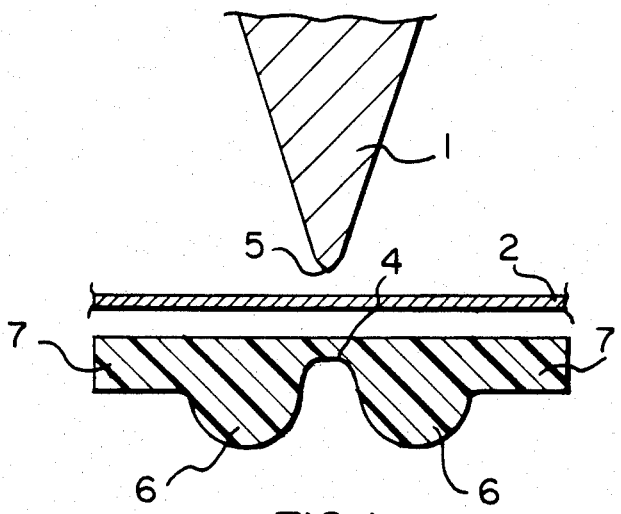

This invention relates to apparatus for press forming a flat metal blank and to a method of press forming.

If it is desired to bend metal sheet at an abrupt angle it is usually done by the "press break" method. In this method a metal male die of V-shaped cross-section cooperates with a female die also of V-shaped cross-section to deform the metal sheet therebetween. The angle of the V of the male die may be, for example 30° to 80°. The angle of the degree of the female die is usually about 90°. The bent metal sheet obtained by this method usually shows markings from the die and may show stress marks along the bends.

It is well known to attempt to avoid markings and stress marks by the use of a male die which cooperates with a pad of resilient elastomeric material as the female die. Such a pad may take the form of cushioning within a holder for the pad of substantially V-shaped configuration. Such an arrangement is disclosed in U.S. Pat. Nos. 3,986,379 and 3,760,622 to Mansell. Alternatively, the holder may comprise generally parallel sidewalls confining a generally rectangular block of die elastomer as described for example in U.S. Pat. No. 3,276,239 to Achler. Various elastomeric materials are suitable for such use and are largely a matter of choice, the main considerations being appropriate hardness and durability. Such pad dies are limited in the thickness of the workpiece with which they can be used because the polyurethane breaks down quickly due to the localised stress at the apex of workpiece bend.

Alternatively a female die may be formed by supported metal bars angled together at a suitable angle dependent on the angle it is desired to achieve in the formed workpiece. In these apparati the metal plates require considerable supporting structure to ensure rigidity when the dies are forced together. Such devices suffer from the disadvantage that it is difficult to achieve a smooth bend of the workpiece at the apex of the bend and various complex proposals have been set forth to solve this problem as for example in U.S. Pat. No. 2,433,841 to Glud which goes so far as to propose a curved extra plate in the female die cooperating with a reversely curved male die.

It remains a problem to form an angle in a flat metal workpiece which is both sharp and accurate without die marks and stress marks or fractures.

According to the present invention there is provided apparatus for press forming a flat metal blank comprising a male die and a female die adapted to act together on a flat metal blank placed therebetween to cold form at least one angle in the blank, the male die being shaped to conform to an inside dimension of the angle and the female die comprising a plank of resilient elastomeric material adapted to bend under the influence of the male die along a longitudinal line corresponding to the apex of the angle whereby, in operation, longitudinal parts of the plank are deformed one to another to conform with an outside dimension of the angle, thus providing supporting sidewalls of the female die, each sidewall including at least one longitudinal reinforcing rib on a surface distant from the metal blank.

Alternatively, according to the invention there is provided a method for press forming at least one angle in a flat metal blank comprising interposing the metal blank between a male die shaped to conform to an inside dimension of the angle and a female die comprising a plank of resilient elastomeric material bendable along a longitudinal line corresponding to an apex of the angle and having at least one longitudinal reinforcing rib on a surface of a longitudinal part thereof to each side of the line and distant from the metal blank, pressing the male die towards the female die to press the blank therebetween, the female die being deformed about the longitudinal line to conform the longitudinal parts to the outside dimensions of the angle as sidewalls for the female die, whereby metal of the metal blank at least partially flows around the angle in response to action between the dies.

The female die may be regarded as being an elastomeric plank having, on one of its flat surfaces, two longitudinal robust ribs lying one to either side of the longitudinal mid line of the plank. The other surface of the plank may be planar. The ribs are conveniently of semicircular cross-section but may be of any convenient cross-section for example, square, curved, rectangular, semi-cylindrical, triangular or the like. The elastomer is preferably a polyurethane.

To use, an elongate metal male die presses the workpiece against the elastomer plank along its longitudinal midline on its planar surface. Under pressure from the die the plank bends along its longitudinal midline to become of somewhat V-shaped cross-section itself. The arms of the bent plank progressively conform more closely with the shape of the male die as the pressure of the die increases. The strengthening ribs lie on the outside of both V-shaped cross-sections as support. Thus the plank hinges longitudinally about the male die. The metal workpiece located between the elastomer plank and the male die is formed around the bend of the hinged plank. Since the hingeing of the plank is a continuously increasing amount as the male die pressure increases, the metal sheet therebetween tends to flow into its new shape rather than be deformed or stretched. The resulting bend in the metal sheet is less stressed and less marked than has hitherto been possible.

Figure 2:
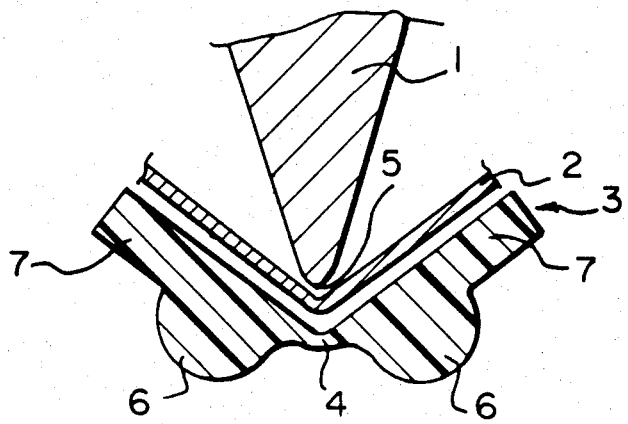

An embodiment of the invention will now be described with reference to the accompanying schematic drawings in which:

FIG. 1 is a diagrammatic sketch of an embodiment of the invention showing a male die and a female die with workpieces therebetween but no pressed and formed; and FIG. 2 shows another diagrammatic section of the same apparatus as FIG. 1 but with press forming started.

The drawings show a male die 1, a workpiece 2 and a female die 3.

The female die 3 is in the form of a plank having a longitudinal median thinned hingeable portion 4 positioned immediately in the path of the apex 5 of the male die. To either side of the thinned hingeable portion 4 of the plank is a longitudinal rib 6 of semicircular section and projecting from the surface of the plank by a distance substantially similar to the thickness of the plank at its parallel edge pieces 7. While the illustrated ribs 6 have semicircular sections, this is not necessary. It is however important that the ribs merge through the thinned hingeable portion 4 in a smooth radiused manner.

The material and dimensions of the plank are dependent on the workpiece to be formed. The distance between the ribs and the thickness of the thinned hingeable portion 4 dictate bend sharpness and bending capacity. Hinge thicknesses from ⅛ to 1 inch are usually the most useful range. The distance between the ribs is usually from 1/16 to 1 inch. Moulded polyurethane of appropriate hardness is preferred for industrial application although extruded plastics material may be used for light forming. The preferred polyurethane is known as tooling grade polyurethane and most preferably has a Shore hardness of 80–95A.

In operation, as the male die 1 presses against the female die 3 through the workpiece 2, the female die progressively hinges about the thinned hingeable portion 4 to form the workpiece so that it eventually conforms to the shape of the male die 1. The thicker edge portions 7 and portions reinforced by ribs 6 support the workpiece efficiently in the forming operation. Very accurate alignment of the apex of the male die 1 with the hingeable portion 4 is not strictly necessary as the hinging of the plank will compensate to some extent for small errors.

It is found that the operation of this combination of male and female die is energy efficient in that there is a bending reaction of the female die rather than penetration thereof. This feature mitigates press overloading.

As the female die 3 progressively bends to conform with the shape of the male die it wraps the work piece 2 around the male die by flowing the metal thereof over a substantial region of the workpiece whereby stress marks caused by sharp bending and resulting in metal crystallisation and possible fracture are mitigated.

A plank which has been found particularly useful is one of moulded polyurethane of Shore hardness 95A. This plank had the following dimensions:

| | |
|---|---|
| Length | 1 ft. |
| Width | 4 ins. |
| Thickness of thinned hingeable portion | ¾ in. |
| Thickness of edge section | ¾ in. |
| Thickness through rib | 1½ in. |
| Width of rib | 1¼ in. |
| Width of edge section | ¾ in. |

Such a plank used as a female die gave satisfactory results in press forming the following materials:

Mild Steel up to ¼ inch thickness

Copper up to ¼ inch thickness

Aluminum up to 5/16 inch thickness

Various male dies having an angle apex varying between a knife edge to one inch radius were used without unduly adversely affecting the quality of the resulting formed workpiece. To form longer workpieces a plurality of such planks placed end to end may be used. These results represent an improvement over those using pad dies. When pad dies are used it is usually not practicable to use workpieces of mild steel of thickness more than ⅛ inch due to breakdown of the pad at the bend apex.

Another plank which has been found useful is one of moulded polyurethane of Shore hardness 90A. The plank had the following dimensions:

| | |
|---|---|
| Length | 4 ft. |
| Width | 3 ins. |
| Thickness of thinned hingeable portion | ¼ in. |
| Thickness of edge section | ¼ in. |
| Thickness through ribs | ⅞ in. |
| Width of ribs | ⅞ in. |
| Width of edge section | ⅜ in. |

Such a plank used as a female die gave satisfactory results in press forming material up to 0.125 thickness.

As with the previously described plank it is possible to form longer workpieces by placing a plurality of planks end to end in a light metal tray. Heavy end stops are not necessary. As before the male dies used varied in the configuration of the apices. Using the above die, 10 feet long 18 gauge stainless steel blanks were formed into 2½" diameter open sided tubing without marking by break marks from each hit.

I claim:

1. Apparatus for press forming a flat metal blank to cold form an angle in said blank, said apparatus comprising:

an elongate female die of resilient elastomeric material, said female die comprising a longitudinal median portion dividing said die into opposite longitudinal halves, a first surface for contact with one side of said metal blank, an opposite surface and a pair of integral spaced longitudinal ribs at said opposite surface;

said longitudinal median portion extending between and parallel to said ribs and said ribs merging with said longitudinal median portion at said opposite side in a smoothly radiused manner; and a male die shaped to conform to the inside dimension of the angle for pressing against the opposite side of said metal blank; wherein said longitudinal median portion constitutes hinge means for allowing said opposite halves of said female die, and therewith said longitudinal ribs, to hinge in opposite directions about said longitudinal median portion, in response to the pressure of said male die and to conform to the outside dimensions of the angle as sidewalls for said female die.

2. Apparatus as claimed in claim 1 in which each said reinforcing rib is of semicircular cross section.

3. Apparatus as claimed in claim 2 in which each reinforcing rib extends over substantially half the width of its respective half of said female die.

4. Apparatus as claimed in claim 1 in which the female die is thinnest at said longitudinal median portion.

5. Apparatus as claimed in claim 1 in which the elastomeric material is a polyurethane.

6. A method for press forming at least one angle in a flat metal blank comprising interposing the metal blank between a male die shaped to conform to an inside dimension of the angle and a female die of resilient elastomeric material bendable along a longitudinal line corresponding to an apex of the angle and having at least one longitudinal reinforcing rib on each of opposite longitudinal halves thereof at opposite sides of the line at a surface of said female die facing away from the metal blank; and pressing the male die towards the female die to press the blank therebetween and thereby causing the opposite longitudinal halves of said female die to hinge, with said ribs, in opposite directions about the longitudinal line and to conform to the outside dimensions of the angle as sidewalls for the female die, the female die being deformed at the area of the longitudinal line without substantial deformation of the opposite longitudinal halves;

whereby metal of the metal blank at least partially flows around the angle in response to action between the dies.

7. A method as claimed in claim 6 in which the angle is V-shaped.

8. A method as claimed in claim 6 in which the elastomer material is a polyurethane.

* * * * *